US005842942A

United States Patent [19]

Doht et al.

[11] Patent Number: 5,842,942

[45] Date of Patent: Dec. 1, 1998

[54] ARROW FOR A CROSSBOW

[75] Inventors: Jochen Doht, Lengerich; Johannes Ossege, Bad Iburg, both of Germany

[73] Assignee: Doht GmbH Maschinenfabrik, Lengerich, Germany

[21] Appl. No.: 985,964

[22] Filed: Dec. 5, 1997

[30] Foreign Application Priority Data

Dec. 13, 1996 [DE] Germany ..... 196 51 818.0

[51] Int. Cl.[6] ..... F42B 6/04

[52] U.S. Cl. ..... 473/578; 473/585

[58] Field of Search ..... 473/578, 585, 473/216, 220

[56] References Cited

U.S. PATENT DOCUMENTS

| | | | |
|---|---|---|---|
| 2,570,782 | 10/1951 | Evatt | 473/578 |
| 3,425,695 | 2/1969 | Kestenbaum | 473/585 |
| 3,945,642 | 3/1976 | Henthorn | 473/585 |
| 5,234,220 | 8/1993 | Schellhammer et al. | 473/578 |

*Primary Examiner*—John A. Ricci

*Attorney, Agent, or Firm*—Evenson, McKeown, Edwards & Lenahan, PLLC

[57] ABSTRACT

An arrow for a crossbow is constructed so that it is particularly rigid and allows for an interchange of different arrow heads while exhibiting the same aerodynamic characteristics. The shaft of the arrow comprises two tubes: an interior tube which is received within an exterior tube; the exterior tube extends beyond the interior tube at the front end of the arrow, and the interior tube extends beyond the exterior tube at the rear end of the arrow. The arrow head includes a shaft which is adapted to seat within the exterior tube at the front of the arrow. The arrow is provided with a tail unit which includes a tubular element which is adapted to be received over the interior tube at the rear of the arrow. This prevents the arrow head from widening the shaft on impact, and allows the tail unit to slide off as the arrow penetrates a target.

7 Claims, 1 Drawing Sheet

ARROW FOR A CROSSBOW

BACKGROUND OF THE INVENTION

1. Field of the Invention

This invention relates to an arrow for a crossbow. The arrow includes a tubular shaft having an arrow head inserted in its front and a tail unit inserted in its rear.

It is the object of the invention to create an arrow for both sports shooting and hunting purposes which, by its construction in accordance with the invention, is both very stable, thereby meeting its mark, and able to be assembled in various ways for different purposes. An arrow in accordance with the invention is very durable and, therefore, may be used repeatedly.

2. Description of Related Art

Arrows having a construction such as that mentioned above, including tubular shafts, are known. Different types of arrow heads are typically inserted into the shaft formed by a tubular pipe. The parts forming the tail unit are inserted into slots in the shaft or glued to the shaft. During impact against hard objects, the rear end of the arrow head is pushed into the tube and causes the tube to deform or widen. Deformations such as this change the aerodynamic characteristics of the arrow and lessen the accuracy of shooting with any further use. Eventually, the arrow becomes practically unusable. The tail unit typically is damaged or completely destroyed with a penetration shot. The shaft, consisting only of a tube, is very flexible and, during a shoot-off, experiences strong vibrations which unfavorably impact on shooting accuracy. Furthermore, known tail units differ from one arrow to another. This also leads to deviations in aiming accuracy.

SUMMARY OF THE INVENTION

According to the present invention, the shaft may consist of two tubes, one of which is inserted into the other. The tubes are connected to each other so that the exterior tube extends beyond the interior tube at one end and the interior tube extends beyond the exterior tube at the other end. The rigidity of the shaft is greatly improved by the insertion of one of the two tubes into the other. Such a construction minimizes the vibrations of the crossbow during a shoot-off. Negative effects with respect to shooting accuracy are also eliminated. The protruding front end portion of the double tube is suitable for inserting the arrow head. The tail unit can be pushed into the other protruding end portion.

The front end of the shaft serves to receive the shaft of the arrow head. The shaft conforms to the length of the protruding end portion of the exterior tube. Thus, the shaft of the arrow head is supported by the interior tube so that the exterior tube is not widened during impact of the arrow. Consequently, the arrow will not change its aerodynamic characteristics even after repeated use.

A tail unit constructed in accordance with the invention is made of a rigid, machine-produced element having a tubular shaped support element. Consequently, the inside diameter of the tail unit is larger than the outer diameter of the portion of the interior rearwardly protruding tube so that these elements may be slidably connected. An accurately manufactured, always matching tail unit is used such that each arrow exhibits the same aerodynamic characteristics. The tail unit is pushed from behind over the interior tube in a simple fashion. The tail units can be colored differently so that they may be distinguishable from each other during a shoot. If the arrows are used in connection with a hunt, then these arrows, or parts thereof, may have a certain camouflaged color matching the outdoor surroundings so that the animals to be shot do not notice the arrows as they fly. If a shot arrow penetrates an object at which it is aimed, then the tail unit can slide off the shaft and remain undamaged.

Constructing the arrow shaft with two tubes makes it possible to provide the rear end portion of the shaft with a part which is insertable into the interior tube. This part includes an elastic buffer at the end which may, for example, be made of rubber. The blow of the string against the arrow is reduced by the elastic buffer during a shoot-off. The arrow, moreover, is less susceptible to vibrations, flies quieter, and can be shot with higher precision. At the same time, the string is preserved. During penetration of the arrow, both the tail unit and the elastic buffer slide off and remain unharmed.

The compound construction of the arrow in accordance with the invention accommodates all types of different arrow heads and, in particular, arrow heads used for hunting and sporting purposes. This type of arrow head includes at least one commonly known blade. The blade is surrounded by a casing form-fitted with respect to the blade. The casing is cone-shaped and easily destructible upon impact of the arrow head and, as a result, the arrow is safely transported and inserted for shooting. The cone-shaped casing allows for the same aerodynamic characteristics in all arrows. The casing is destroyed upon impact, making the sharp blades fully effective.

It is desirable, with small game, to effect a kill by way of a certain shock effect occurring upon impact of the arrow. Greater injury to the killed game is thereby avoided. Thus, in order to obtain the greatest possible impact surface, a sieve-type, perforated disc may be attached perpendicular to the flight direction in the area of the arrow head. The perforated disc produces only minor drag, which allows for precise shooting of the arrow over a long distance. Additionally, if the arrow is misfired, then the disc prevents the arrow from penetrating the ground and getting lost. As soon as the disc touches the ground, the arrow falls over and remains on the ground for easy retrieval.

Different arrow heads may be used due to the special construction of the arrow in accordance with the invention. Accurate shooting of these arrows is always allowed, making it unnecessary to adjust the crossbow each time different arrows and/or arrow heads are used.

DESCRIPTION OF THE PREFERRED EMBODIMENTS

Figure 1:
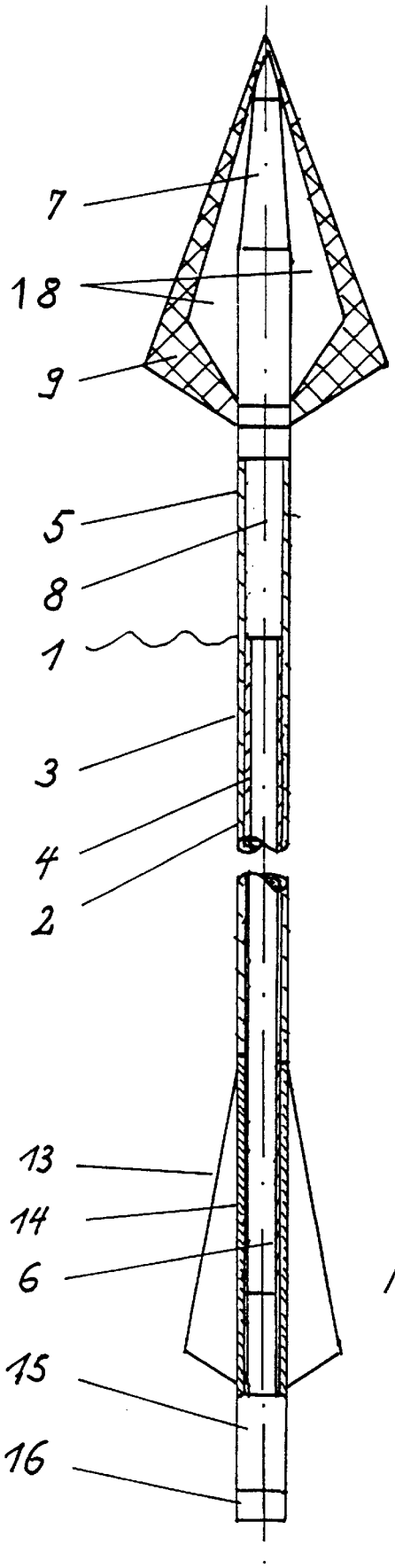
FIG. 1 is a side, part sectional view of an arrow in accordance with the invention with a head which is equipped with knife-like blades.

The arrow 1 according to FIG. 1 includes a shaft 2 consisting of an exterior tube 3 and an interior tube 4 tightly connected thereto. The front end portion 5 of the exterior tube 3 extends beyond the interior tube 4 and the rear end portion 6 of the interior tube 4 extends beyond the exterior tube 3.

The arrow head 7 has a shaft 8 which is inserted into the front end 5 of the exterior tube 3. The shaft 8 is supported by the interior tube 4. This guarantees that the head 7 with its shaft 8 cannot be pressed further into the exterior tube 3 during a hard impact of the arrow, thereby preventing damage to the arrow 1.

The arrow head 7 is provided with sharp blades 18 surrounded by a conically formed casing 9 which is made of an easily destructible material. Such a material may, for example, be STYROFOAM (an expanded rigid polystyrene plastic) or paper-mache. The casing 9 is destroyed upon impact of the arrow 1, allowing the blades their full effect. This casing 9 protects the marksman while handling the arrow 1. More importantly, however, the casing 9 makes for arrow heads always having the same shape, the same aerodynamic characteristics, and the same shooting accuracy.

Figure 2:
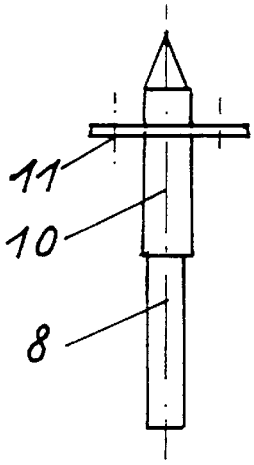
FIG. 2 is a view of an arrow head including a sieve-like, perforated disc.
Figure 3:
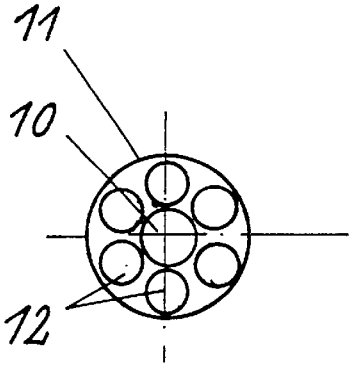
FIG. 3 is a front view of the arrangement shown in FIG. 2.

The arrow head 10 according to FIGS. 2 and 3 has the same shaft 8 as the arrow head 1. The shaft 8 is inserted into the front end portion 5 of an exterior tube 3 of an arrow shaft 2. A disc 11 is provided with sieve-like holes for decreasing air resistance. During a hunt for small game, the animal is killed by way of a shock effect produced upon impact by this relatively large surface of the disc 11. Larger injuries are avoided. Additionally, the disc 11 prevents the arrow 1 from penetrating the ground after a miss and thereby assists in retrieval. The arrow 1 will fall over as the disc 11 touches the ground and is easily retrieved.

The tail unit 13, including a tube-shaped support element 14, is slipped over the rear end portion 6 of the interior tube 4. The element 15, containing a rubber buffer 16, is inserted into the interior tube 4. If the arrow 1 penetrates an object, then both the tail unit 13 and the element containing the rubber buffer 16 can still slide off and remain intact.

The tail unit 13 is machine manufactured, for example, of rigid PVC (polyvinyl chloride). Thus, the tail unit can always keep a uniform shape for each arrow which is to be equipped with the exact same tail unit. This allows for the same shooting accuracy of each of the arrows. Different coloration of the tail units 13 make them easy to distinguish and allow for the necessity of camouflage to match surroundings during a hunt.

The particular embodiments described above are only examples and are not to be considered the only embodiments encompassed by the following claims.

We claim:

1. An arrow for a crossbow comprising:

a tube-shaped shaft, an arrow head inserted in a front end of said tube-shaped shaft, and a tail unit inserted in a rear end of said tube-shaped shaft, wherein the shaft comprises two tubes, one of said tubes being an interior tube which is inserted into and connected to the other tube, the other tube being an exterior tube which extends beyond the interior tube at the front end, the interior tube extending beyond the exterior tube at the rear end.

2. The arrow according to claim 1, wherein the front end serves as a seat for a shaft of the arrow head, and a length of the shaft of the arrow head corresponds to a length of a protruding front end portion of the exterior tube.

3. The arrow according to claim 1, wherein the tail unit includes a rigid, machine produced part having a tube-shaped support element, the support element having an inside diameter which is larger than an outside diameter of a rearward protruding end portion of the interior tube so that the support element can slide over said rearward protruding end portion.

4. The arrow according to claim 3, wherein the rear end of the shaft is formed with a part retractable in the interior tube which includes an elastic buffer.

5. The arrow according to claim 4, wherein said elastic buffer is made of rubber.

6. The arrow according to claim 1, wherein the arrow head is provided with at least one knife-like blade surrounded by a casing form-fitted to the blade and easily destructible upon impact of the arrow head.

7. The arrow according to claim 1, and further comprising a disc provided on said arrow head, directed perpendicular to a flight direction, and having sieve-like holes.

* * * * *